US012339049B2

(12) United States Patent
Lu et al.

(10) Patent No.: US 12,339,049 B2
(45) Date of Patent: Jun. 24, 2025

(54) MAKING DEVICE OF ICE BALLS

(71) Applicant: AW Industries LLC, Cypress, CA (US)

(72) Inventors: Xiang-Tai Lu, New Taipei (TW); Shi-Jie Wang, Taichung (TW); Wei-Yuan Huang, Taichung (TW); Zhi-Xiang Dai, New Taipei (TW); Jeff Chen, Buena Park, CA (US)

(73) Assignee: AW Industries LLC, Cypress, CA (US)

( * ) Notice: Subject to any disclaimer, the term of this patent is extended or adjusted under 35 U.S.C. 154(b) by 230 days.

(21) Appl. No.: 18/323,664

(22) Filed: May 25, 2023

(65) Prior Publication Data

US 2023/0384013 A1 Nov. 30, 2023

(30) Foreign Application Priority Data

May 26, 2022 (TW) ..... 111205524

(51) Int. Cl.
*F25C 1/04* (2018.01)

(52) U.S. Cl.
CPC ..... *F25C 1/04* (2013.01)

(58) Field of Classification Search
CPC ..... F25C 1/04; F25C 2700/14; F25C 1/22
(Continued)

(56) References Cited

U.S. PATENT DOCUMENTS 3,640,081 A * 2/1972 Hadden ..... F41J 1/01 273/362
3,721,103 A * 3/1973 Brandt ..... F25C 1/04 62/73

(Continued)

FOREIGN PATENT DOCUMENTS

CN 102878743 A * 1/2013 ..... F25C 1/04
CN 112113374 A * 12/2020

(Continued)

OTHER PUBLICATIONS

International Search Report and Written Opinion for International Patent Application No. PCT/US2023/023511 dated Aug. 25, 2023 (13 pages).

*Primary Examiner* — Eric S Ruppert
*Assistant Examiner* — Kirstin U Oswald
(74) *Attorney, Agent, or Firm* — Goodwin Procter LLP

(57) ABSTRACT

A making device of ice balls comprises a refrigeration chamber unit; the refrigeration chamber unit comprises a lower half ball mold body, an upper half ball mold body and a water circulation unit; in addition, a cover plate is arranged above the refrigeration chamber unit, and a water injection hole is arranged on the cover plate; in addition, a plurality of low-temperature condensing tubes are arranged in the lower half ball mold body; in addition, the refrigeration chamber unit further comprises a thermo electric cooler, and a cold end face of the thermo electric cooler is attached to a bottom surface of the lower half ball mold body; the upper half ball mold body is arranged above the lower half ball mold body, a plurality of convection circulation holes are distributed on the upper half ball mold body, and a water inlet hole is arranged in the center of the upper half ball mold body; and the water circulation unit is arranged on the cover plate and comprises a pump, and the pump is respectively connected with a water inlet tube and a water outlet tube. Therefore, in addition to making crystal clear old ice balls without impurities, the making device is high in making speed, can shorten the making time of the ice balls, and has the advantage of rapid making.

7 Claims, 8 Drawing Sheets

(58) Field of Classification Search
USPC ..... 62/340
See application file for complete search history.

(56) References Cited

U.S. PATENT DOCUMENTS

| | | | | | |
|---|---|---|---|---|---|
| 4,055,053 | A * | 10/1977 | Elfving | F25B 21/02 | 62/344 |
| 4,727,720 | A | 3/1988 | Wernicki | | |
| 8,882,489 | B1 * | 11/2014 | Coomer | F25C 5/14 | 425/408 |
| 11,408,661 | B2 * | 8/2022 | Junge | F25C 5/08 | |
| 2006/0254285 | A1 * | 11/2006 | Lin | F25C 1/04 | 62/340 |
| 2012/0186292 | A1 * | 7/2012 | Kim | F25C 1/20 | 62/340 |
| 2013/0327074 | A1 * | 12/2013 | Lee | F25C 1/04 | 62/177 |
| 2014/0047859 | A1 * | 2/2014 | Schwulst | F25C 5/08 | 62/340 |
| 2014/0165598 | A1 * | 6/2014 | Boarman | F25C 1/22 | 62/347 |
| 2014/0165599 | A1 * | 6/2014 | Boarman | F25B 21/02 | 62/3.3 |
| 2014/0165610 | A1 * | 6/2014 | Boarman | F25C 1/00 | 62/3.63 |
| 2014/0165618 | A1 * | 6/2014 | Culley | F25C 1/18 | 62/71 |
| 2014/0165619 | A1 * | 6/2014 | Culley | F25C 5/08 | 62/344 |
| 2014/0165620 | A1 * | 6/2014 | Culley | F25C 1/18 | 62/71 |
| 2014/0165624 | A1 * | 6/2014 | Boarman | F25C 1/12 | 62/340 |
| 2015/0367536 | A1 * | 12/2015 | Compton | F25C 1/22 | 425/395 |
| 2016/0084558 | A1 | 3/2016 | Boarman et al. | | |
| 2016/0377335 | A1 * | 12/2016 | Boarman | F25C 1/22 | 62/75 |
| 2019/0293335 | A1 * | 9/2019 | Bertolini | F25C 1/04 | |
| 2020/0041186 | A1 * | 2/2020 | Junge | F25C 1/25 | |
| 2020/0400359 | A1 * | 12/2020 | Junge | F25C 5/14 | |
| 2021/0318049 | A1 * | 10/2021 | Moczygemba | F25C 1/22 | |

FOREIGN PATENT DOCUMENTS

| | | | | | |
|---|---|---|---|---|---|
| CN | 212585254 | U * | 2/2021 | F25C 1/04 | |
| DE | 202009005291 | U1 * | 8/2009 | A47J 36/2483 | |
| EP | 2570755 | A2 * | 3/2013 | F25C 5/22 | |
| EP | 2645021 | A2 * | 10/2013 | F25C 1/04 | |
| JP | H0670542 | B2 * | 9/1994 | | |
| KR | 100853425 | B1 * | 8/2008 | | |
| KR | 20090019322 | A * | 2/2009 | | |
| KR | 20120076327 | A * | 7/2012 | | |
| KR | 20130110874 | A * | 10/2013 | | |
| KR | 20130110875 | A * | 10/2013 | | |
| KR | 20160084891 | A * | 7/2016 | | |
| KR | 20160084930 | A * | 7/2016 | | |
| WO | WO-0218855 | A1 * | 3/2002 | F25C 1/18 | |
| WO | WO-2014174314 | A2 * | 10/2014 | A23G 9/24 | |
| WO | WO-2021147584 | A1 * | 7/2021 | F25C 1/04 | |

* cited by examiner

MAKING DEVICE OF ICE BALLS

CROSS-REFERENCE TO RELATED APPLICATION

This application claims priority to and the benefit of, and incorporates herein by reference in its entirety, Taiwanese Patent Application No. 111205524, which was filed on May 26, 2022.

TECHNICAL FIELD

The disclosure relates to an ice making device, in particular to a making device of ice balls, which can produce crystal clear ice balls quickly and shorten the making time.

BACKGROUND

With the improvement of people's living standards, more and more people like to add ice balls into alcoholic beverages. Because the ice balls melt slowly, they can reduce the temperature of alcohol without easily diluting the concentration of the alcohol itself. Therefore, the alcohol such as Visa and Old Brandy are often drank with the ice balls to make them taste better; and coupled with the aesthetic effect of the ice balls themselves, there is a great demand in the catering market.

At present, there are mainly two making ways for the ice balls on the market. One is that bartenders hand-sculpt transparent ice cubes into balls, and this way has obvious disadvantages of poor completeness, low efficiency, high cost and incapability of mass production. The other one is that ice is manufactured by using molds, please refer to FIG. 1, and the making way comprises the following steps: step 1: pouring water into a container without a cover on the top and having a heat preservation effect, and placing the container in a cabinet freezer for standing for 24 hours; step 2: after 24 hours, producing a square ice cube in the heat preservation container, wherein the square ice cube is approximately divided into three layers including fog ice on a bottom layer, supercooled water and needle ice on a middle layer and crystal clear old ice on an upper layer; step 3: removing ice layers below the middle layer, and taking out old ice layers; step 4: dividing the old ice layers into several square strips, and cutting to obtain ice cubes with appearance like step 5; step 6: placing old ices which are in a square strip shape after dividing into an ice ball mold, and slowly performing pressure casting molding by using gravity and a metal heat dissipation way; step 7: obtaining a crystal clear round ice ball.

As for this making way of ice balls, the icing way in pre-operation adopts a convection way for icing, so that not only the icing efficiency is slow, but also a long and multi-step process is needed to complete shaping operation of the ice balls for ice formed after 24 hours. Therefore, it is very time-consuming in making and really needs to be improved.

In view of this, the inventors believe that the making of the ice balls still needs to be further improved after observing the above shortcomings, and thus the present disclosure is produced.

SUMMARY OF THE INVENTION

A main purpose of the disclosure is to provide a making device of ice balls, so that crystal clear old ice balls without impurities can be manufactured to reduce the melting speed of the ice balls, and the aesthetic effect of beverages is increased; and in addition, the making device is high in making speed and can shorten the making time of the ice balls, so as to achieve the purpose of rapid making.

To achieve the above purpose, the disclosure provides the making device of ice balls, which comprises a refrigeration chamber unit; the refrigeration chamber unit comprises a lower half ball mold body, wherein the lower half ball mold body is a hollow cylinder made of metal heat-conducting materials, a half-ball-shaped lower chamber is arranged on a lower half part of the lower half ball mold body in a concave manner, in addition, a cover plate is arranged above the refrigeration chamber unit, a water injection hole is arranged on the cover plate, in addition, a plurality of low-temperature condensing tubes are arranged in the lower half ball mold body, in addition, the refrigeration chamber unit further comprises a thermo electric cooler, and a cold end face of the thermo electric cooler is attached to a bottom surface of the lower half ball mold body; an upper half ball mold body, wherein the upper half ball mold body is arranged above the lower half ball mold body, the upper half ball mold body is also made of metal heat-conducting materials, the upper half ball mold body is downwards provided with a half-ball-shaped upper chamber in a concave manner in correspondence with the lower chamber, the upper chamber and the lower chamber jointly form a round ball shape, in addition, a plurality of convection circulation holes are distributed on the upper chamber, and a water inlet hole is arranged in the center of the upper half ball mold body; and a water circulation unit, wherein the water circulation unit is arranged on the cover plate and comprises a pump, the pump is respectively connected with a water inlet tube and a water outlet tube, the other end of the water inlet tube and the other end of the water outlet tube both extend into the refrigeration chamber unit, and the water inlet tube is located over the water inlet hole.

Further, the refrigeration chamber unit is provided with a heat dissipation unit on a hot end face of the thermo electric cooler, the heat dissipation unit comprises a plurality of medium-temperature condensing tubes, one end of each medium-temperature condensing tube is jointly attached to the hot end face of the thermo electric cooler, and the other end of each medium-temperature condensing tube is jointly connected with a heat sink and a heat dissipation fan.

Further, a fixing plate is arranged on the medium-temperature condensate tubes, the medium-temperature condensate tubes are fixed to the lower half ball mold body through the fixing plate by means of locking of a plurality of fixing bolts, and the fixing bolts are made of plastic materials with poor thermal conductivity.

Further, the low-temperature condensing tubes are generally L-shaped, one end of each low-temperature condensing tube extends into a perimeter wall of the lower half ball mold body, the other end of each low-temperature condensing tube is exposed outside the bottom surface of the lower half ball mold body, each low-temperature condensing tube forms a flat part respectively, so that the flat parts and a bottom surface of the upper half ball mold body are jointly attached to the cold end face of the thermo electric cooler.

Further, an electronic control unit is also included and comprises a microprocessor, the microprocessor is electrically connected with a temperature sensor, the temperature sensor is arranged in the refrigeration chamber unit and can be used to sense the temperature of water in the refrigeration chamber unit, and in addition, the microprocessor is electrically connected with the pump, so that the microprocessor can control action of the pump. In addition, the electronic control unit further comprises a relay, the relay is electrically connected with the thermo electric cooler, and the relay can control the thermo electric cooler to obtain forward voltage or reverse voltage.

Further, a thermal insulation layer is arranged on an outer side of the lower half ball mold body in an annular manner.

Further, a rubber washer is arranged at a bottom periphery of the upper half ball mold body in an annular manner.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention. In the following description, various embodiments of the present invention are described with reference to the following drawings, in which.

DESCRIPTION

Figure 1:
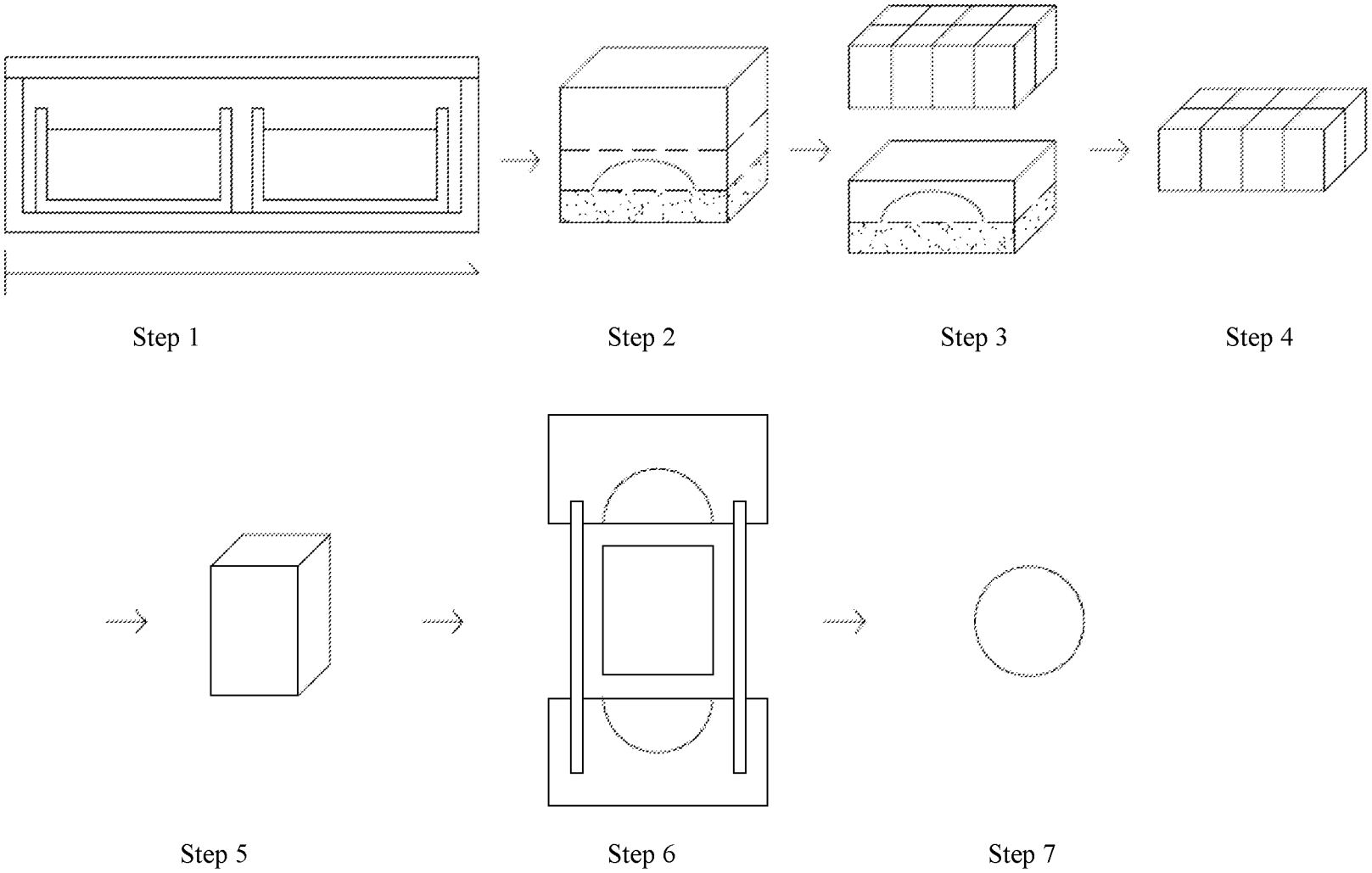
FIG. 1 is a flow chart of traditional ice ball making.
Figure 2:
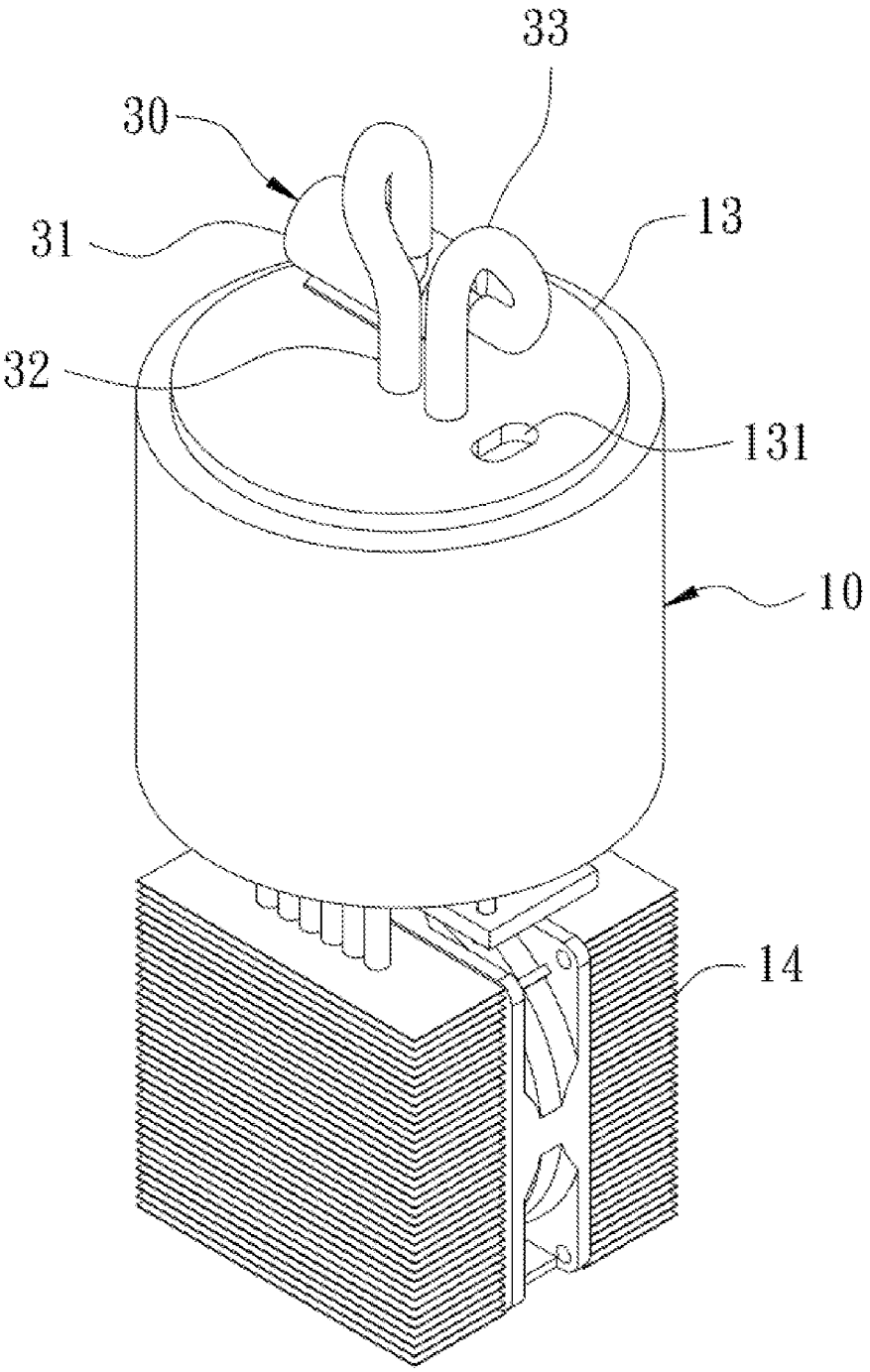
FIG. 2 is a combined stereogram of a preferred example of the present disclosure.
Figure 3:
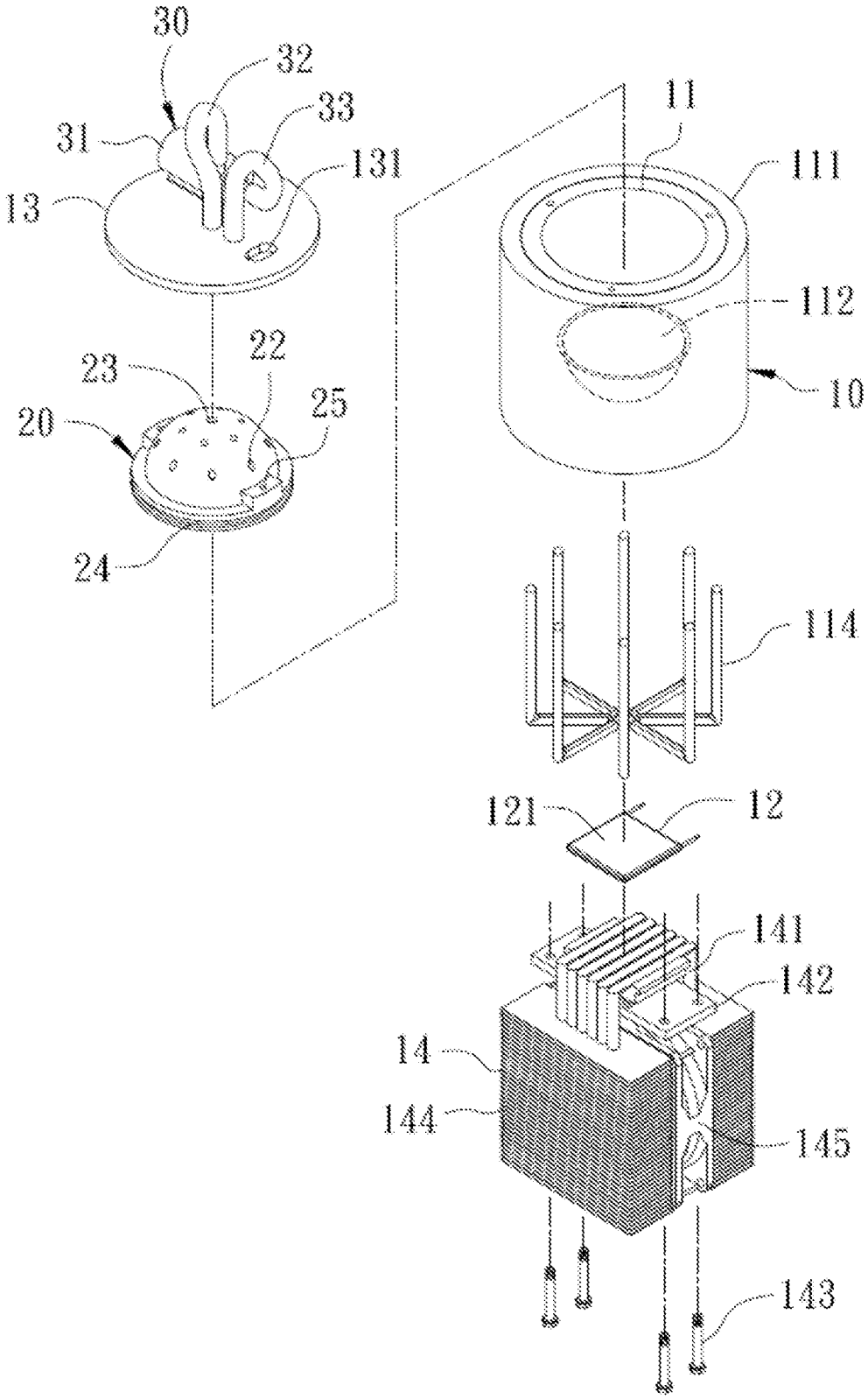
FIG. 3 is a decomposed stereogram of the preferred example of the present disclosure.
Figure 4:
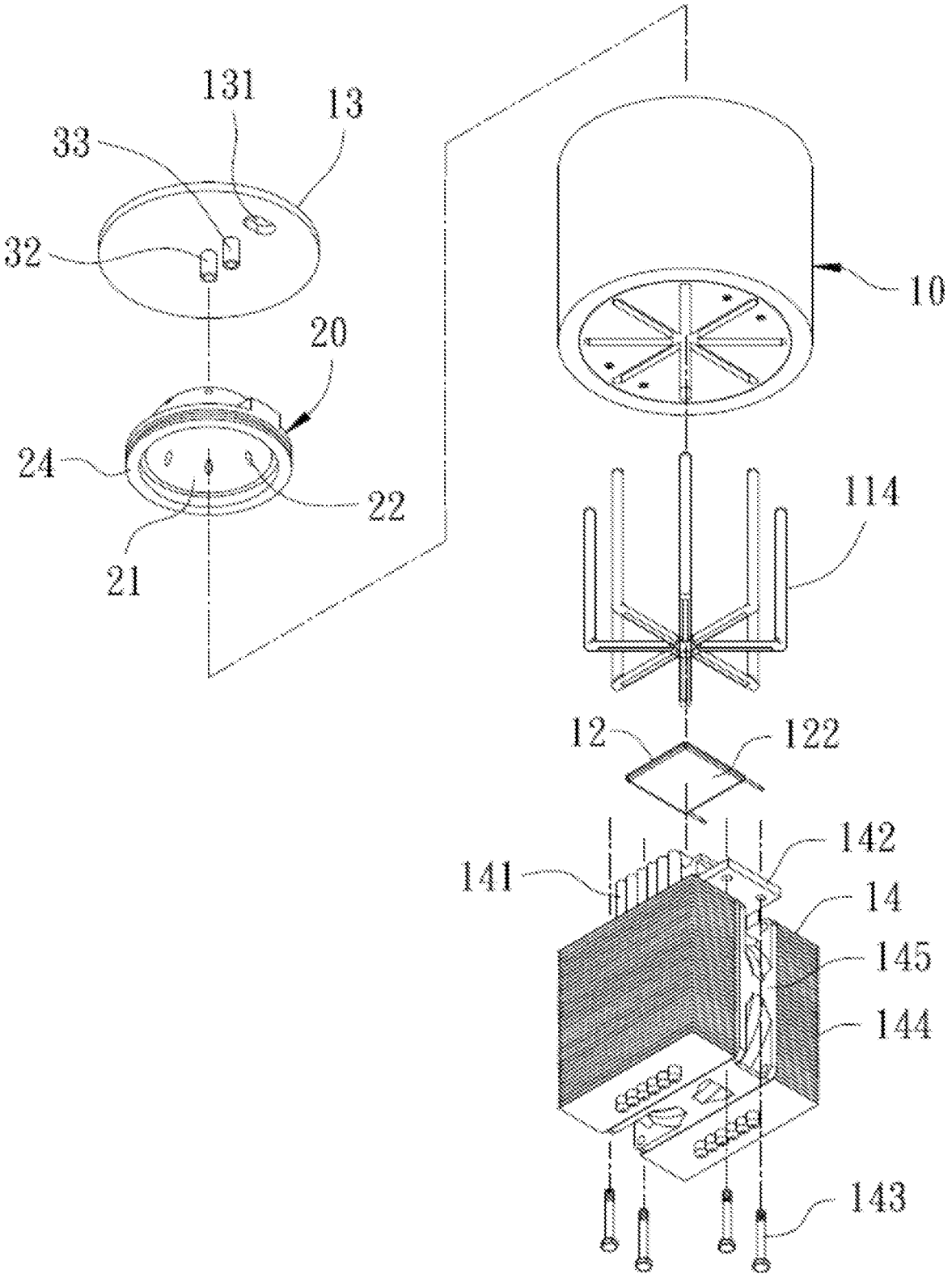
FIG. 4 is another decomposed stereogram of the preferred example of the present disclosure.
Figure 5:
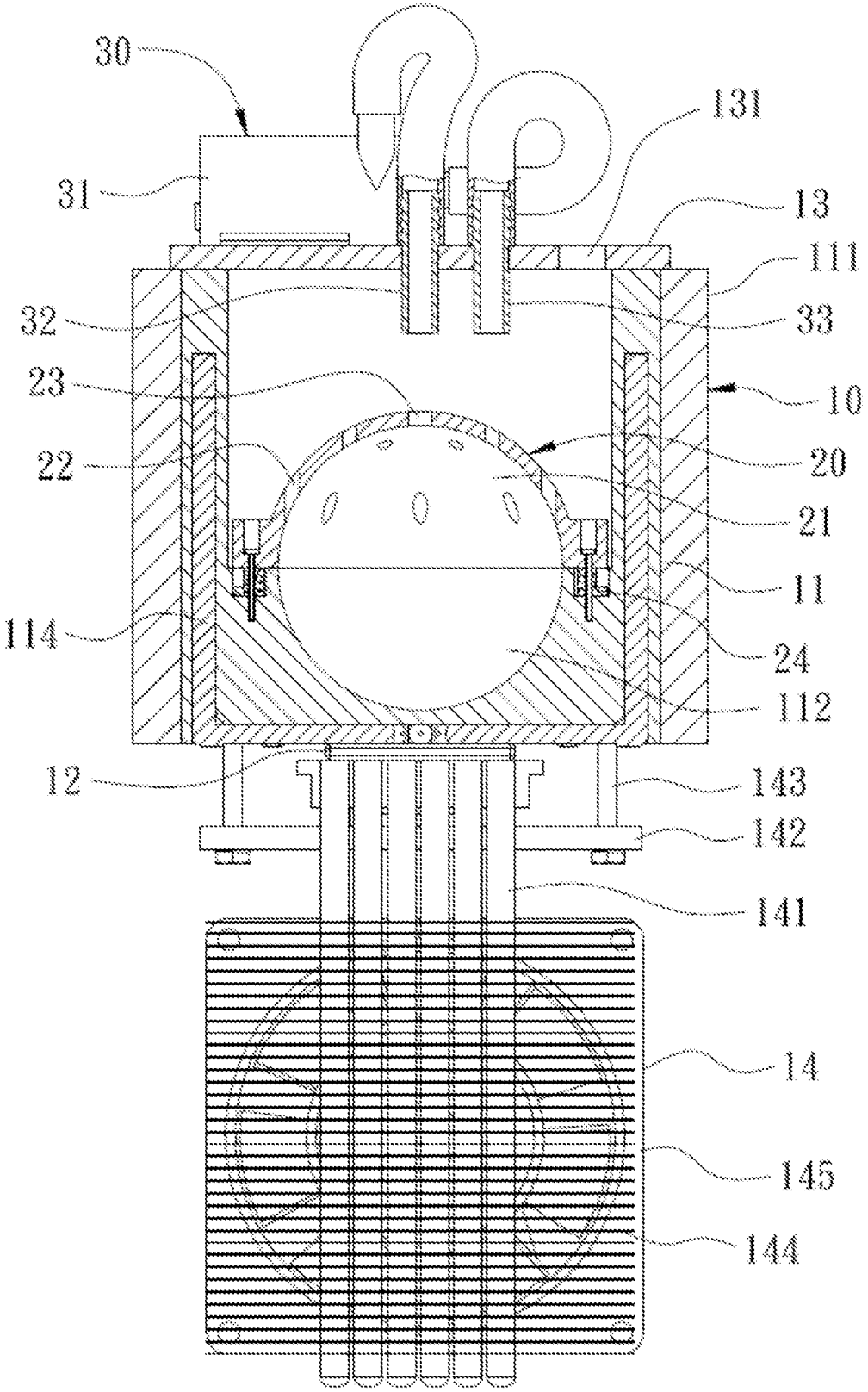
FIG. 5 is a combined sectional view of the preferred example of the present disclosure.

Please refer to FIGS. 2-5 which are the combined stereogram, the decomposed stereogram and the combined sectional view of the preferred example of the present disclosure respectively, which comprises:

A refrigeration chamber unit 10, wherein the refrigeration chamber unit 10 comprises a lower half ball mold body 11, the lower half ball mold body is a hollow cylinder made of copper or aluminum and other metal heat-conducting materials, the outer side of the lower half ball mold body is wrapped with a thermal insulation layer 111, such as EVA foam, which can be used for preventing convection current formed by refrigeration chamber and outer temperature from affecting the refrigerating efficiency; in the example, a half-ball-shaped lower chamber 112 is arranged on a lower half part of the lower half ball mold body 11 upwards in a concave manner, but the shape is not limited to a half ball shape; a surface of the lower chamber 112 is ground into a mirror surface and sprayed with a food-grade heat conduction paint layer, the purpose of grinding into the mirror surface is to reduce the loss of cold radiation in ball bodies so as to increase the refrigerating efficiency; in addition, a plurality of closed low-temperature condensing tubes 114 are arranged in the lower half ball mold body 11, the low-temperature condensing tubes 114 are all L-shaped, a longitudinal end of each low-temperature condensing tube extends into a perimeter wall of the lower half ball mold body 11, and a transverse end of each low-temperature condensing tube is exposed outside a bottom surface of the lower half ball mold body 11, each low-temperature condensing tube forms a flat part respectively, so that the flat parts and the bottom surface of the lower half ball mold body 11 are on the same plane, wherein a length of the longitudinal end of each low-temperature condensing tube 114 needs to be greater than or equal to a spherical diameter, and the low-temperature condensing tubes are symmetrically and evenly distributed in the peripheral wall of the lower half ball mold body 11 in an even number, so as to be used for improving the refrigerating efficiency and reaching the refrigerating temperature and average temperature effect in the lower half ball mold body 11; and the consistency of the size and specification of the low-temperature condensing tubes 114 can facilitate production and reduce costs; in addition, the purpose of adopting the low-temperature condensing tubes 114 in the lower half ball mold body 11 is to prevent freezing in the low-temperature condensing tubes during low temperature and reduce the efficiency of cold and heat exchange in the condensing tubes; the refrigeration chamber unit 10 further comprises a thermo electric cooler 12 (TEC), the thermo electric cooler 12 is arranged on the bottom surface of the lower half ball mold body 11, the thermo electric cooler 12 has a cold end face 121 and a hot end face 122, the cold end face 121 of the thermo electric cooler 12 is pasted on the bottom surface of the lower half ball mold body 11 after being coated with heat dissipation paste, so that the area and efficiency of direct thermal conductivity can be increased, and the refrigerating speed can be increased to achieve a rapid freezing effect; the refrigeration chamber unit 10 is provided with a heat dissipation unit 14 on the hot end face 122 of the thermo electric cooler 12, the heat dissipation unit 14 comprises a plurality of closed medium-temperature condensing tubes 141, one end of each medium-temperature condensing tube 141 is further jointly attached to the hot end face 122 of the thermo electric cooler 12 after being coated with heat dissipation paste, a fixing plate 142 is arranged on the medium-temperature condensing tubes 141, the medium-temperature condensing tubes are fixed to the lower half ball mold body 11 through the fixing plate 142 by means of locking of a plurality of fixing bolts 143, wherein the fixing bolts 143 are made of plastic materials with poor thermal conductivity, so that the cross influence between the cold end face and the hot end face of the thermo electric cooler 12 can be prevented; in addition, the other end of each medium-temperature condensing tube 141 is jointly connected with a heat sink 144 and a heat dissipation fan 145, so that the heat dissipation effect of the hot end face 122 of the thermo electric cooler 12 is improved; and in addition, the refrigeration chamber unit 10 is provided with a cover plate 13 above the lower half ball mold body 11, and a water injection hole 131 is arranged on the cover plate 13, so that water can be injected into the refrigeration chamber unit 10 from the outside.

An upper half ball mold body 20, wherein the upper half ball mold body is located in the refrigeration chamber unit 10 and is located above the lower half ball mold body 11, and the upper half ball mold body 20 is also made of copper or aluminum and other metal heat conducting materials; in the example, the upper half ball mold body 20 is provided with a half ball shape in a concave manner in correspondence with the shape of the upper chamber 112, so as to have a lower chamber 112 with an opening facing downwards; therefore, the upper chamber 21 and the lower chamber 112 can clamp each other to form a spherical shape; in addition, a plurality of convection circulation holes 22 are distributed on the upper chamber 21 of the upper half ball mold body 20, a water inlet hole 23 in a vertical direction is arranged in the center, in addition to providing a water circulation tube and path, the convection circulation holes 22 also provide a tube path for the balls to expand upwards due to the fact that the volume becomes larger after freezing; in addition, a rubber washer 24 is arranged on the bottom periphery of the upper half ball mold body 20 in an annular manner, and the rubber washer is mainly used to prevent the upper half ball mold body 20 from being pushed out due to the expansion of the volume when the balls are frozen, so as to prevent the production of irregular shapes of the round ice balls after ice making; and in addition, two sides of the upper half ball mold body 20 are respectively provided with a hole 25 with the effect that an inverted U-shaped handle can be placed on the holes 25 on the two sides before freezing, so that the ice cubes can be conveniently taken out by using the U-shaped handle after freezing.

A water circulation unit 30, wherein the water circulation unit is arranged above the cover plate 13 and comprises a pump 31, the pump 31 is respectively connected with a water inlet tube 32 and a water outlet tube 33, the other ends of the water inlet tube 32 and the water outlet tube 33 both extend into the refrigeration chamber unit 10, and the water inlet tube 32 is located over the water inlet hole 23; and the water circulation unit 30 can inject a quantitative amount of water into the refrigeration chamber unit 10 via an external water injection hole 131, and the pump 31 is used to perform circulating water flow velocity control on the water flow path and tube in the refrigeration chamber unit 10.

Figure 6:
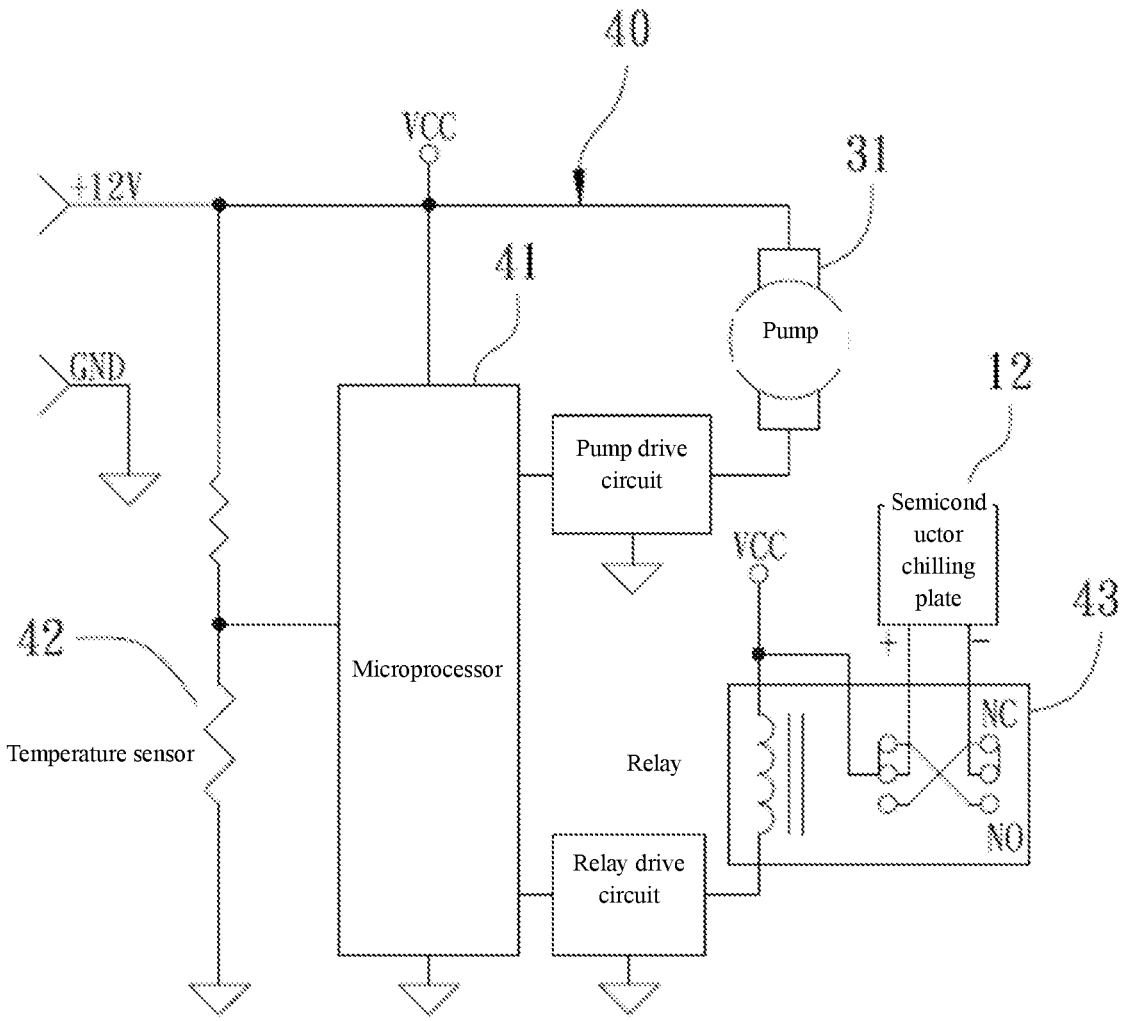
FIG. 6 is a circuit block diagram of the preferred example of the present disclosure.

An electrical control unit 40, please refer to FIG. 6, the electrical control unit 40 comprises a microprocessor 41, the microprocessor 41 is electrically connected to a temperature sensor 42, and the temperature sensor 42 is located in the refrigeration chamber unit 10 and can be used for sensing the temperature of water in the refrigeration chamber unit 10; in addition, the microprocessor 41 is electrically connected to the pump 31, so that the microprocessor 41 can control action of the pump 31; and in addition, the electronic control unit 40 further comprises a relay 43, the relay 43 is electrically connected to the thermo electric cooler 12, the relay 43 can control a power supply and wiring of positive and negative ends of the thermo electric cooler 12, so that the thermo electric cooler 12 obtains forward voltage or reverse voltage.

Figure 7:
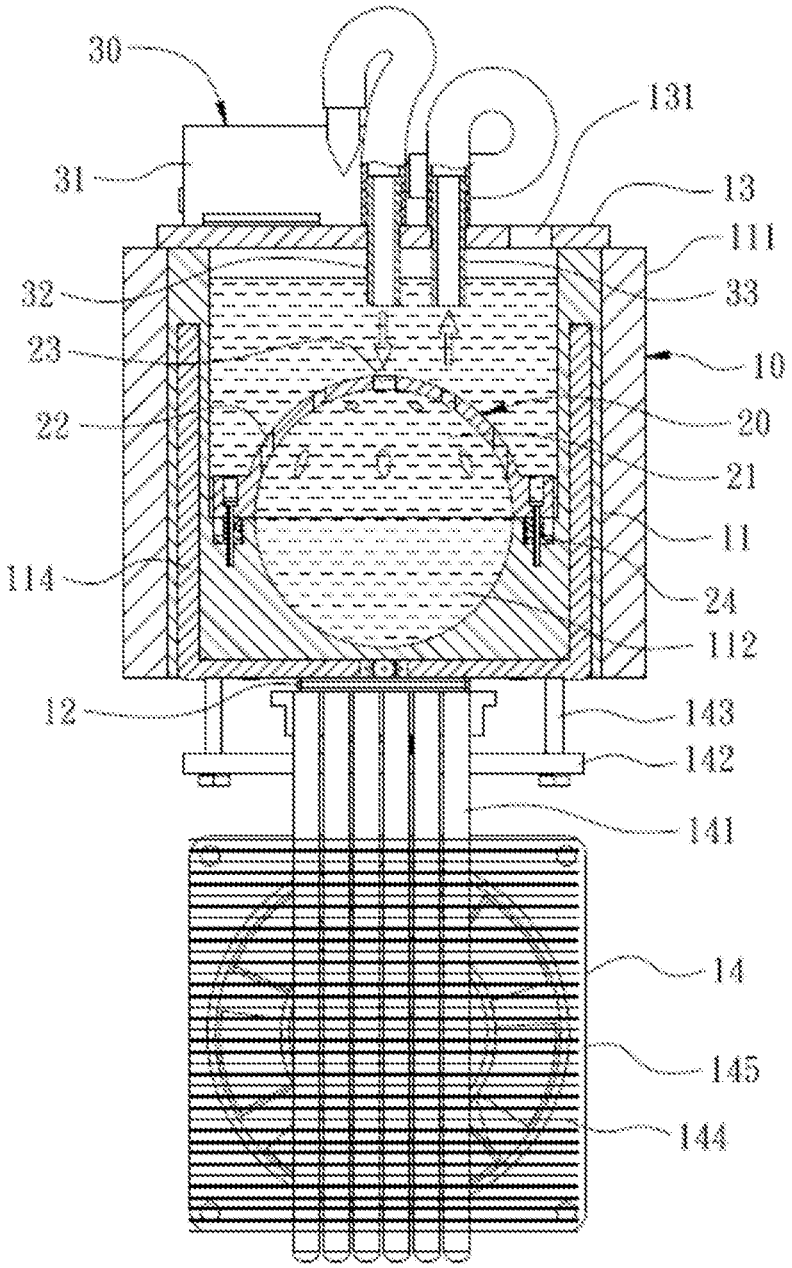
FIG. 7 is a schematic of use of the preferred example of the present disclosure.
Figure 8:
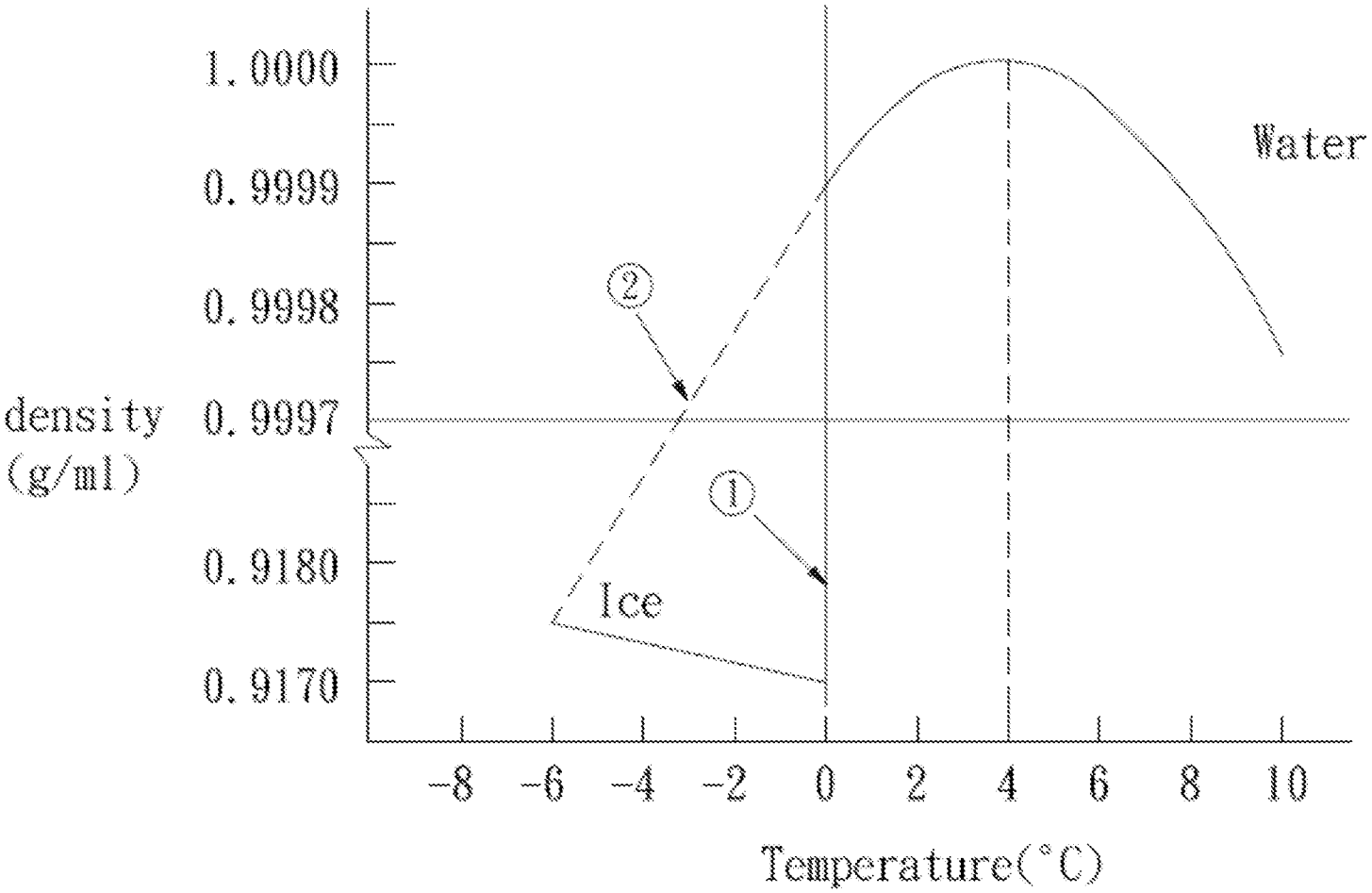
FIG. 8 is a graph of density and temperature of water.

In order to further understand the structural characteristics, the adopted technical means and the intended effect of the preferred example of the present disclosure, the using ways and the action principle of the preferred example of the present disclosure are hereby described, and it is believed that a more in-depth and specific understanding of the preferred example of the present disclosure can be obtained, as described below:

please refer to FIG. 7, when the ice balls are intended to be manufactured by the preferred example of the present disclosure, firstly, mineral water or boiled water is injected into the refrigeration chamber unit 10 through the water injection hole 131; at this time, the water will flow into a spherical chamber defined by the upper chamber 21 and the lower chamber 112 via the water inlet hole 23, and the water level only needs to be between the upper cover 13 and a tube opening of the water inlet tube 32; secondly, the electronic control unit 40 is started, and a power supply of the thermo electric cooler 12 and the pump 31 is provided by the electronic control unit 40; in the initial stage, the thermo electric cooler 12 obtains the forward voltage by action of a contact of the relay 43, the cold end face 121 of the thermo electric cooler 12 will produce low temperature at this time, and the low temperature is transmitted to the lower half ball mold body 11 by means of the low-temperature condensing tubes 114, so that the water temperature in the chamber gradually decreases from bottom to top; and when the water temperature is above 4° C., the pump 31 rotates at a constant speed to eliminate bubbles in the water. Please refer to FIG. 8 which is the graph of density and temperature of water, it can be seen from this figure that the density of water is highest at 4° C., that is, the water is viscous; when the water temperature is lower than 4° C., the water will begin to freeze; and when water molecular groups and ice crystals form ice in extremely unstable conditions at 0° C., bubbles in water are covered by ice and cannot be discharged, thereby forming the ice spine phenomenon in ice bodies; and water is in an extremely unstable ① vertical zone of water molecule groups (liquid) and ice crystals (solid) at 0° C. The preferred example of the present disclosure uses the temperature sensor 42 to sense the water temperature in the chamber, a pulse width modulation (PWM) signal is output to the pump 31 via the microprocessor 41, water flow velocity control is continuously performed, the pulse width modulation action is increased until 0° C., the duty cycle of pulse width modulation is slowly reduced according to the water temperature in the chamber, and heat energy generated by the water flow is used to control the condensation core speed produced in water below or equal to 0° C. The Figure ① and the unstable curve are slowly transferred to Figure ② the stratified freezing curve, so as to eliminate the instant phase transformation of bubbles into ice at 0° C., the bubbles are enclosed in ice to generate the fog ice phenomenon, and the purposes of stratified freezing and crystal clear can be achieved. Finally, when the water body is completely frozen, the thermo electric cooler 12 obtains the reverse voltage by means of the action of the contact of the relay 43, so that the refrigeration and heating faces are switched in the direction to increase the speed and reduce difficulty of detachment of ice ball entities from the chamber, the upper half ball mold body 20 can be opened conveniently, and the ice bodies in the chamber are taken out. In this way, a crystal-clear ice ball product can be obtained.

Hereby, the characteristics of this preferred example of the present disclosure and its intended effects are stated as follows:

1. The preferred example of the present disclosure uses the rapid cooling effect of the thermo electric cooler, so that the making time of the ice balls can be shortened, and the purpose of rapid making of the ice balls are accordingly achieved.
2. The preferred example of the present disclosure uses the circulation pump to continuously stir and flow the water body, so that gas and impurities in the water body in the chamber can be removed, a uniform temperature effect on the water body can be produced, and the purposes of stratified freezing and crystal clear can be accordingly achieved.
3. The preferred example of the present disclosure uses the electronic control unit to perform pulse width modulation (PWM) control on the pump, so that the ice spine phenomenon in the ice bodies due to the fact that the bubbles in water are wrapped with ice and cannot be discharged when the water molecule groups and the ice crystals are frozen in the extremely unstable situation at 0° C. can be avoided.
4. The preferred example of the present disclosure uses the electronic control unit to provide the reverse voltage to the thermo electric cooler, so that the refrigeration and heating faces can be switched, and the demolding of the ice ball entities can be facilitated.

To sum up, the preferred example of the present disclosure has its excellent progress and practicability in similar products. At the same time, after the technical data of this structure at home and abroad are searched, the same structure has not been found in the literature.

However, the above is only one of the best feasible examples of the present disclosure, and therefore any equivalent structural change in the application of this specification and the scope of the patent application should be included in the scope of the patent.

What is claimed is:

1. A making device of ice balls, comprising:

a refrigeration chamber unit, wherein the refrigeration chamber unit comprises a lower half ball mold body, the lower half ball mold body is a hollow cylinder made of metal heat-conducting materials, and a half-ball-shaped lower chamber is arranged on a lower half portion of the lower half ball mold body in a concave manner; in addition, a cover plate is arranged above the refrigeration chamber unit, and a water injection hole is arranged on the cover plate; in addition, a plurality of low-temperature condensing tubes are arranged in the lower half ball mold body; in addition, the refrigeration chamber unit further comprises a thermo electric cooler, and a cold end face of the thermo electric cooler is attached to a bottom surface of the lower half ball mold body;

an upper half ball mold body, wherein the upper half ball mold body is arranged above the lower half ball mold body, the upper half ball mold body is also made of metal heat-conducting materials, the upper half ball mold body is downwards provided with a half-ball-shaped upper chamber in a concave manner in correspondence with the lower chamber, and the upper chamber and the lower chamber jointly form a round sphere shape; in addition, a plurality of convection circulation holes are distributed on the upper chamber, and a water inlet hole is arranged in the center of the upper half ball mold body; and a water circulation unit, wherein the water circulation unit is arranged on the cover plate and comprises a pump, the pump is respectively connected with a water inlet tube and a water outlet tube, the other end of the water inlet tube and the other end of the water outlet tube both extend into the refrigeration chamber unit, and the water inlet tube is located over the water inlet hole.

2. The making device of ice balls according to claim 1, wherein the refrigeration chamber unit is provided with a heat dissipation unit on a hot end face of the thermo electric cooler, the heat dissipation unit comprises a plurality of medium-temperature condensing tubes, one end of each medium-temperature condensing tube is jointly attached to the hot end face of the thermo electric cooler, and the other end of each medium-temperature condensing tube is jointly connected with a heat sink and a heat dissipation fan.

3. The making device of ice balls according to claim 2, wherein a fixing plate is arranged on the medium-temperature condensing tubes, the medium-temperature condensate tubes are fixed to the lower half ball mold body through the fixing plate by means of locking of a plurality of fixing bolts, and the fixing bolts are made of plastic materials with poor thermal conductivity.

4. The making device of ice balls according to claim 1, wherein the low-temperature condensing tubes are generally L-shaped, one end of each low-temperature condensing tube extends into a perimeter wall of the lower half ball mold body, the other end of each low-temperature condensing tube is exposed outside the bottom surface of the lower half ball mold body, each low-temperature condensing tube forms a flat part respectively, and the flat parts and a bottom surface of the upper half ball mold body are jointly attached to the cold end face of the thermo electric cooler.

5. The making device of ice balls according to claim 1, wherein an electronic control unit is further included and comprises a microprocessor, the microprocessor is electrically connected with a temperature sensor, and the temperature sensor is arranged in the refrigeration chamber unit and can be used to sense the temperature of water in the refrigeration chamber unit; in addition, the microprocessor is electrically connected with the pump, so that the microprocessor can control action of the pump; and in addition, the electronic control unit further comprises a relay, the relay is electrically connected with the thermo electric cooler, and the relay can control the thermo electric cooler to obtain forward voltage or reverse voltage.

6. The making device of ice balls according to claim 1, wherein a thermal insulation layer is arranged on an outer side of the lower half ball mold body in an annular manner.

7. The making device of ice balls according to claim 1, wherein a rubber washer is arranged at a bottom periphery of the upper half ball mold body in an annular manner.

* * * * *